US009321064B2

(12) United States Patent
Vanier

(10) Patent No.: US 9,321,064 B2
(45) Date of Patent: Apr. 26, 2016

(54) DRINKING VESSEL WITH PUMP AND METHODS

(71) Applicant: Blake Vanier, Boulder, CO (US)

(72) Inventor: Blake Vanier, Boulder, CO (US)

( * ) Notice: Subject to any disclaimer, the term of this patent is extended or adjusted under 35 U.S.C. 154(b) by 43 days.

(21) Appl. No.: 14/010,473

(22) Filed: Aug. 26, 2013

(65) Prior Publication Data

US 2013/0341359 A1 Dec. 26, 2013

Related U.S. Application Data

(63) Continuation-in-part of application No. 13/245,803, filed on Sep. 26, 2011, now abandoned.

(60) Provisional application No. 61/404,013, filed on Sep. 24, 2010.

(51) Int. Cl.

| | |
|---|---|
| ***B65D 37/00*** | (2006.01) |
| ***B05B 11/04*** | (2006.01) |
| ***A47G 19/22*** | (2006.01) |
| ***B05B 9/08*** | (2006.01) |
| ***B05B 11/00*** | (2006.01) |
| ***B65D 41/26*** | (2006.01) |

(52) U.S. Cl.

CPC ..... *B05B 11/046* (2013.01); *A47G 19/2272* (2013.01); *B05B 9/0816* (2013.01); *B05B 11/30* (2013.01); *B65D 41/26* (2013.01)

(58) Field of Classification Search

CPC .... B05B 11/046; B05B 9/0816; B05B 11/30; B05B 41/26; A47G 19/2272

USPC ..... 222/209, 205, 401, 481, 491, 556, 211; 215/307, 309, 311, 315, 262; 220/203.01, 715, 714, 231; 141/65, 25, 141/26, 320, 321, 322; 251/62, 63, 63.5, 251/63.6

See application file for complete search history.

(56) References Cited

U.S. PATENT DOCUMENTS

| | | | | | |
|---|---|---|---|---|---|
| 398,528 | A | * | 2/1889 | Molin | 222/205 |
| 850,805 | A | * | 4/1907 | Stewart | 222/328 |
| 943,951 | A | * | 12/1909 | Moody | 215/311 |
| 1,296,341 | A | * | 3/1919 | Towle | 222/481 |
| 1,576,763 | A | * | 3/1926 | Ingram | 215/260 |
| 1,576,811 | A | * | 3/1926 | Clark | B05B 1/22 137/377 |

(Continued)

FOREIGN PATENT DOCUMENTS

| | | | |
|---|---|---|---|
| DE | 19742464 | A1 | 9/1997 |
| WO | WO99/45828 | A1 | 9/1999 |
| WO | WO2009/055067 | A2 | 4/2009 |

*Primary Examiner* — Patrick M Buechner
*Assistant Examiner* — Michael J Melaragno

(57) ABSTRACT

A vessel, such as an insulated container, for liquids having a lower portion sealed with an upper portion, such upper portion having a drinking reservoir for holding liquid which is pumped from the lower portion through a dispensing passage, such as a liquid dispensing tube, by a pump mechanism coupled with the upper portion. The pump mechanism is ergonomically operable by way of depressing a feature of the pump mechanism, e.g., by a single finger of the same hand holding the vessel. The upper portion, coupled with the pump mechanism, is redisposable on the lower portion, transposable in relation to any other lower portion, and retrofittable in relation to any other interfaceable pre-existing containers. The pump mechanism is optionally provided with a button or soft membrane. The components of the vessel are easily disassembled and reassembled for facilitating cleaning thereof.

14 Claims, 7 Drawing Sheets

(56) References Cited

U.S. PATENT DOCUMENTS 1,719,286 A * 7/1929 Carrillo ..... 222/323
2,131,809 A * 10/1938 Killen ..... 137/517
2,210,206 A * 8/1940 Fisher ..... A45D 34/04 215/386
2,447,870 A * 8/1948 Polcyn ..... A47G 19/2272 215/309
2,578,201 A * 12/1951 Nicorvo ..... 215/315
2,679,337 A * 5/1954 Leach ..... G01F 11/084 222/209
2,774,517 A * 12/1956 Teegardin et al. ..... 222/205
2,808,966 A * 10/1957 Hall ..... B67D 1/0425 222/207
2,886,218 A * 5/1959 Marcus ..... 222/517
3,018,022 A * 1/1962 Jones ..... 222/340
3,105,619 A * 10/1963 Rohrmuller ..... 222/209
3,782,577 A * 1/1974 Levey ..... 215/206
3,806,023 A * 4/1974 Barnett ..... 229/404
3,847,311 A * 11/1974 Flores et al. ..... 222/473
3,877,614 A * 4/1975 Murphy ..... 222/209
3,964,631 A * 6/1976 Albert ..... 220/715
3,967,748 A * 7/1976 Albert ..... 220/715
3,972,443 A * 8/1976 Albert ..... B65D 47/249 220/254.5
3,987,938 A * 10/1976 Cooprider ..... B05B 11/3032 222/209
4,099,642 A * 7/1978 Nergard ..... 220/715
4,133,446 A * 1/1979 Albert ..... 220/715
4,136,799 A * 1/1979 Albert ..... 220/298
4,190,173 A * 2/1980 Mason et al. ..... 220/203.05
4,212,408 A * 7/1980 Valenzona ..... 220/254.5
4,294,369 A * 10/1981 Racine ..... 215/311
4,303,173 A * 12/1981 Nergard ..... 220/254.5
4,314,658 A * 2/1982 Laauwe ..... 222/213
4,441,637 A * 4/1984 Libit ..... 222/556
4,582,218 A * 4/1986 Ross ..... 220/290
4,621,743 A * 11/1986 DiRegolo et al. ..... 215/308
4,625,884 A * 12/1986 Zimmermann ..... 222/131
4,690,300 A * 9/1987 Woods ..... 220/592.17
4,712,704 A * 12/1987 Ramsey et al. ..... 220/254.4
4,757,922 A * 7/1988 Landecker ..... 222/205
4,782,985 A * 11/1988 Kinsley ..... 222/481.5
4,793,516 A * 12/1988 Niwa et al. ..... 222/143
4,848,600 A * 7/1989 Dark ..... 222/498
4,966,300 A * 10/1990 Coonradt ..... 220/707
5,067,637 A * 11/1991 Aurness et al. ..... 222/175
5,085,336 A * 2/1992 Lynd ..... 220/708
5,222,623 A * 6/1993 Eger et al. ..... 220/715
5,249,703 A * 10/1993 Karp ..... 220/719
5,312,019 A * 5/1994 Tsao ..... 222/105
5,405,030 A * 4/1995 Frazier ..... 215/6
5,462,189 A * 10/1995 Pierce ..... 220/815
5,465,866 A * 11/1995 Belcastro ..... 220/709
5,477,980 A * 12/1995 Chaffin ..... 220/715
5,485,938 A * 1/1996 Boersma ..... 220/714
5,560,513 A * 10/1996 Jarrell ..... 220/705
5,611,376 A * 3/1997 Chuang ..... B65B 31/047 141/65
5,651,470 A * 7/1997 Wu ..... F16J 13/24 141/65
5,680,951 A * 10/1997 Feltman et al. ..... 220/253
5,697,510 A * 12/1997 Wang et al. ..... 215/262
5,823,380 A * 10/1998 Cox ..... 220/502
5,918,761 A * 7/1999 Wissinger ..... 220/713
5,961,004 A * 10/1999 DeMars ..... 222/205
5,964,379 A * 10/1999 DeMars ..... 222/205
6,098,834 A * 8/2000 Hatsumoto et al. ..... 220/715
6,105,809 A * 8/2000 Yamanaka ..... 220/326
6,116,476 A * 9/2000 Huang ..... B65D 47/249 222/506
6,202,877 B1 * 3/2001 La Torre et al. ..... 220/254.1
6,206,058 B1 * 3/2001 Nagel et al. ..... 141/302
6,216,903 B1 * 4/2001 Hirose ..... A47G 19/2272 220/253
6,276,560 B1 * 8/2001 Belcastro ..... 220/709
6,471,085 B1 * 10/2002 Gallo ..... 220/501
6,471,390 B1 * 10/2002 Cuthbertson et al. ..... 366/101
6,571,973 B1 * 6/2003 Tripsianes ..... 222/256
6,763,964 B1 * 7/2004 Hurlbut et al. ..... 220/254.3
6,786,352 B2 * 9/2004 Belcastro ..... 220/714
6,802,438 B2 * 10/2004 Thompson ..... 222/175
6,854,615 B2 * 2/2005 von Ronn et al. ..... 220/253
7,073,678 B1 * 7/2006 Dibdin et al. ..... 220/254.1
7,131,558 B2 * 11/2006 de la Guardia ..... 222/209
7,402,092 B1 * 7/2008 Randall et al. ..... 446/74
7,413,096 B2 * 8/2008 Morgan et al. ..... 220/254.9
7,497,349 B2 * 3/2009 Allen ..... 220/501
7,878,373 B2 * 2/2011 Lindmayer ..... B65D 47/2062 222/153.13
8,360,267 B1 * 1/2013 Chiou et al. ..... 220/715
8,464,895 B2 * 6/2013 Gilbert et al. ..... 220/703
8,550,280 B2 * 10/2013 Steuer ..... 220/203.01
8,814,005 B2 * 8/2014 Banks ..... B01F 5/0478 222/145.5
2004/0159684 A1 * 8/2004 Roberts et al. ..... 222/556
2006/0175331 A1 * 8/2006 Lin ..... A47G 19/2272 220/254.5
2007/0131725 A1 * 6/2007 Friedman ..... B67D 1/14 222/518
2007/0138121 A1 * 6/2007 Stribling et al. ..... 215/11.4
2007/0210093 A1 * 9/2007 Pinelli ..... A47G 19/2272 220/715
2008/0272134 A1 * 11/2008 Rohe ..... 220/713
2008/0308183 A1 * 12/2008 Law ..... 141/380
2009/0108003 A1 * 4/2009 Tripsianes ..... 220/521
2009/0236373 A1 * 9/2009 Laib et al. ..... 222/484
2009/0302063 A1 * 12/2009 Maas et al. ..... 222/205
2010/0200602 A1 * 8/2010 Chan ..... 220/714
2011/0062169 A1 * 3/2011 Nakhaeinejad ..... 220/705
2012/0000942 A1 * 1/2012 Fang ..... 222/209
2012/0006860 A1 * 1/2012 Suffa et al. ..... 222/491
2012/0074173 A1 * 3/2012 Vanier ..... 222/209

* cited by examiner

DRINKING VESSEL WITH PUMP AND METHODS

CROSS-REFERENCE TO RELATED APPLICATIONS

This document is a continuation-in-part application which is related to, and claims priority through U.S. Nonprovisional patent application Ser. No. 13/245,803, also entitled "Bottle with Drinking Reservoir and Pump," filed Sep. 26, 2011, which, in turn, is related to, and claims to U.S. Provisional Application No. 61/404,013, also entitled "Bottle with Drinking Reservoir and Pump," filed Sep. 24, 2010, wherein all the subject matter of the foregoing patent documents, including any amendments thereto, are hereby incorporated by reference in their entirety.

TECHNICAL FIELD

The present disclosure pertains to the field of liquid containers. More particularly, the present disclosure pertains to the field of containers that help maintain the liquid's temperature and allow for easy consumption. Even more particularly, the present disclosure relates to liquid containers which maintain the liquid's temperature, facilitate liquid consumption, minimize the chances of spillage and leakage.

BACKGROUND

In the related art, conventional closed liquid containers, often called bottles, cups, mugs, coffee cups, thermoses, etc., only allow easy access to the main reservoir of liquid. In the case of a liquid desired at an elevated temperature, this causes some problems. When considering a standard cup or bottle, one must wait until the liquid cools to a safe temperature before consuming. This waiting is also accompanied by frequent testing of the liquid to determine its temperature either by tasting it from the container and risking a burn, or pouring the liquid out and letting it cool in the air to the desired temperature. When the liquid reaches the desired consumption temperature a window of opportunity is then opened when the liquid must be consumed before it drops below such temperature. If the mug is not insulated, this window of time may be quite short. In the case of an insulated mug or container, the window of time to consume the liquid is much larger; however, the insulating properties of the container can also make it difficult to judge when the liquid is at a safe temperature to consume and will prolong the time taken for the liquid to reach the desired temperature, both problems of which are well-known to those who drink hot beverages. An additional issue with related art liquid containers is the ability to clean them effectively, especially when the container has moving and sealing components, in most instances the complexity of the pumps and valves of related art liquid containers, prevent them from being easily removable and cleaned.

SUMMARY

In addressing the foregoing problems in the related art drinking vessels, the present disclosure generally involves a vessel, comprising: a lower portion having a closed bottom portion, an open top portion, and sidewalls, the closed bottom portion and the sidewalls forming a holding reservoir; an upper portion disposable in relation to the lower portion, the upper portion having a drinking reservoir, and the upper portion capable of enclosing the open top portion of the lower portion for preventing at least one of leakage and spillage; and a pump mechanism, the pump mechanism coupled with the upper portion, the pump mechanism comprising a liquid dispensing tube having a proximal end and a distal end, the proximal end capable of coupling with the upper portion and the distal end extendable into the holding reservoir, and the pump mechanism being activable for facilitating flow of a pressurized gas into the holding reservoir, whereby a liquid is displaceable from the holding reservoir through the liquid dispensing tube into the drinking reservoir.

Further, the present disclosure involves a method of fabricating a vessel, the method comprising: providing a lower portion having a closed bottom portion, an open top portion, and sidewalls, the closed bottom portion and the sidewalls forming a holding reservoir; providing an upper portion disposable in relation to the lower portion, the upper portion providing comprising providing the upper portion as having a drinking reservoir, and the upper portion providing comprising providing the upper portion as capable of enclosing the open top portion of the lower portion for preventing at least one of leakage and spillage; and providing a pump mechanism, the pump mechanism coupled with the upper portion, the pump mechanism providing comprising providing the pump mechanism with a liquid dispensing tube having a proximal end and a distal end, the proximal end capable of coupling with the upper portion and the distal end extendable into the holding reservoir, and the pump mechanism being activable for facilitating flow of a pressurized gas into the holding reservoir, whereby a liquid is displaceable from the holding reservoir through the liquid dispensing tube into the drinking reservoir.

Even further, the present disclosure involves a method of using a vessel, comprising: providing a vessel, the vessel provided comprising: providing a lower portion having a closed bottom portion, an open top portion, and sidewalls, the closed bottom portion and the sidewalls forming a holding reservoir; providing an upper portion disposable in relation to the lower portion, the upper portion provided comprising providing the upper portion as having a drinking reservoir, and the upper portion provided comprising providing the upper portion as capable of enclosing the open top portion of the lower portion for preventing at least one of leakage and spillage; and providing a pump mechanism, the pump mechanism coupled with the upper portion, the pump mechanism provided comprising providing the pump mechanism with a liquid dispensing tube having a proximal end and a distal end, the proximal end capable of coupling with the upper portion and the distal end extendable into the holding reservoir, and the pump mechanism being activable for facilitating flow of a pressurized gas into the holding reservoir, whereby a liquid is transmittable from the holding reservoir through the liquid dispensing tube into the drinking reservoir; and activating the pump mechanism, whereby the liquid is transmitted from the holding reservoir to the drinking reservoir.

The vessel and methods include, but are not limited to, the following beneficial features. None of the following beneficial features must be entirely satisfied, as they are non-exclusive alternatives; and, if at least one of the following features is satisfied, the subject matter is encompassed by the present disclosure. Accordingly, several beneficial features of the vessel and methods are:

(a) to provide an insulated bottle with a lid that contains a reservoir for the containment of liquid that is open to the air;

(b) to provide a feature, e.g., a pump, for pumping liquid from the inside of a bottle to a reservoir that is open to the air on the lid of a bottle;

(c) to provide a feature, e.g., a pump, for pumping liquid from a bottle to a reservoir that is open to the air on the lid of a bottle, such pumping means being a part of the lid of the bottle;

(d) to provide a feature, e.g., a pump, for pumping liquid from a bottle to a reservoir that is open to the air on the lid of a bottle that is conveniently operated with a single finger on the hand that holds the bottle;

(e) to provide a feature, e.g., a pump, for pumping liquid from a bottle to a reservoir that is open to the air on the lid of a bottle that is durable, flexible, and texturally appealing to the finger;

(f) to provide a feature, e.g., a pump, for pumping liquid from a bottle to a reservoir that is open to the air on the lid of a bottle that is streamlined and will not catch on other objects;

(g) to provide a feature, e.g., a pump, for pumping liquid from a bottle to a reservoir that is open to the air on the lid of a bottle that is easy to produce;

(h) to provide a feature, e.g., a pump, for pumping liquid from a bottle to a reservoir that is open to the air on the lid of a bottle that is easy to disassemble and clean;

(i) to provide a feature, e.g., a pump, for pumping liquid from a bottle to a reservoir that is open to the air on the lid of a bottle that is easy to fix or replace;

(j) to provide a feature, e.g., a pump, for pumping liquid from a bottle to a reservoir that is open to the air on the lid of a bottle that is durable and unlikely to break;

(k) to provide a feature, e.g., a pump, for pumping liquid from a bottle to a reservoir that can be conveniently opened and closed to prevent unwanted liquid from pouring from the bottle to the reservoir or leaking;

(l) to provide a feature, e.g., a pump, for pumping liquid from a bottle to a reservoir that prevents unwanted splash back toward the user; and (m) to provide a feature, e.g., a pump, for pumping liquid from a bottle to a reservoir that has a few number of parts for manufacturing.

The foregoing features and other beneficial features of the instant disclosure will become apparent from the following description, taken in conjunction with the accompanying Drawing, wherein are set forth, by way of illustration and example, certain embodiments described by the instant disclosure. The Drawing constitutes a part of this Specification and includes exemplary embodiments of the present disclosure and illustrate various benefits and features thereof.

BRIEF DESCRIPTION OF THE DRAWING

The above, and other, aspects, features, and advantages of several embodiments of the present disclosure will be more apparent from the following Detailed Description as presented in conjunction with the following several figures of the Drawing.

Figure 1A:
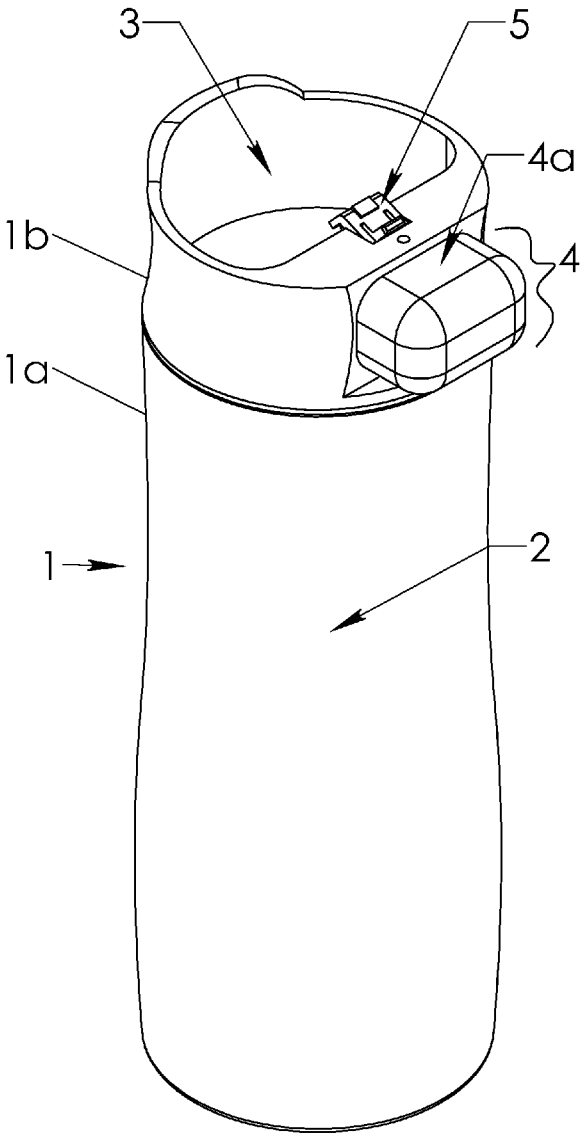
FIG. 1A is a diagram illustrating a perspective view of a vessel, in accordance with an embodiment of the present disclosure.

Corresponding reference characters indicate corresponding components throughout the several figures of the Drawing. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood, elements that are useful or necessary in commercially feasible embodiment are often not depicted in order to facilitate a less obstructed view of these various embodiments of the subject matter in the present disclosure.

DETAILED DESCRIPTION

The following description is not to be taken in a limiting sense, but is made merely for the purpose of describing the general principles of exemplary embodiments. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

Further, the described features, structures, or characteristics of the present disclosure may be combined in any suitable manner in one or more embodiments. In the Detailed Description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well-known structures, materials, or operations are not shown or described in detail to avoid obscuring aspects of the present disclosure.

For the purposes of promoting an understanding of the principles of the present disclosure, reference will now be made to the embodiments illustrated in the drawings and specific language will be used to describe the same. However, the illustrated embodiments are merely exemplary and many additional embodiments in the present disclosure are possible. For example, bottles are pictured; however, the subject matter of the present disclosure can be applied to most cups and mugs. Understood is that no limitation of the scope of the subject matter of the present disclosure is thereby intended. Any alterations and further modifications in the illustrated devices, and such further application of the principles of the subject matter of the present disclosure, as illustrated herein, are contemplated as would normally occur to one skilled in the art to which the subject matter of the present disclosure relates.

Shown throughout the figures, the subject matter of the present disclosure is generally directed toward an upper portion, such as a small cup shaped lid, which either has a pump or is facilitated by a pump for the purpose of pumping liquid from the inside of a bottle or container to a reservoir on the lid.

Example 1

Embodiment with a Closable Spout

Referring to FIG. 1A, this diagram illustrates a perspective view of a vessel 1, such as a bottle or a container, in accordance with an embodiment of the present disclosure. The vessel 1 comprises a lower portion 1*a*, having a holding reservoir 2, and an upper portion 1*b*, having a drinking reservoir 3, a closable spout 5, and a pump mechanism 4. The holding reservoir 2 is used to store the bulk of the liquid. When a user (not shown) desires, the user will use the accompanied pump mechanism 4 to move the liquid into the drinking reservoir 3 which accommodates a volume of liquid that is less than the maximum volume capacity of the holding reservoir 2. Once the liquid (not shown) is disposed in the drinking reservoir 3, the user may consume the liquid when it meets the user's specific preferences. The pump mechanism 4 comprises a pump membrane 4*a* coupled with a receiving edge of the upper portion 1*b*.

Still referring to FIG. 1A, in further detail, the holding reservoir 2 comprises a size for accommodating a volume of liquid that is adequate for a user consuming his or her beverage of choice. The size of the holding reservoir 2 is not limited, but is capable of accommodating a volume of liquid in a range of approximately 8 oz to approximately 32 oz. Likewise, the drinking reservoir 3 must be of an adequate size to meet the user's needs. The drinking reservoir 3 is not limited to, but is capable of safely accommodating a volume of liquid in a range of approximately 1 oz to approximately 4 oz without risk of spilling. The drinking reservoir 3 comprises a feature for facilitating liquid consumption by the user, such as: a lip, spout, straw, or any other feature that serves a similar function. The pump mechanism 4 comprises an adequate size for displacing the liquid from the holding reservoir 2 to the drinking reservoir 3 with a reasonable amount of effort by the user. The user should be able to initiate movement of the desired amount of liquid to the drinking reservoir 3 by actuating the pump, e.g., in a range of approximately 1 pump to approximately 6 pumps of the pumping mechanism 4.

Figure 1B:
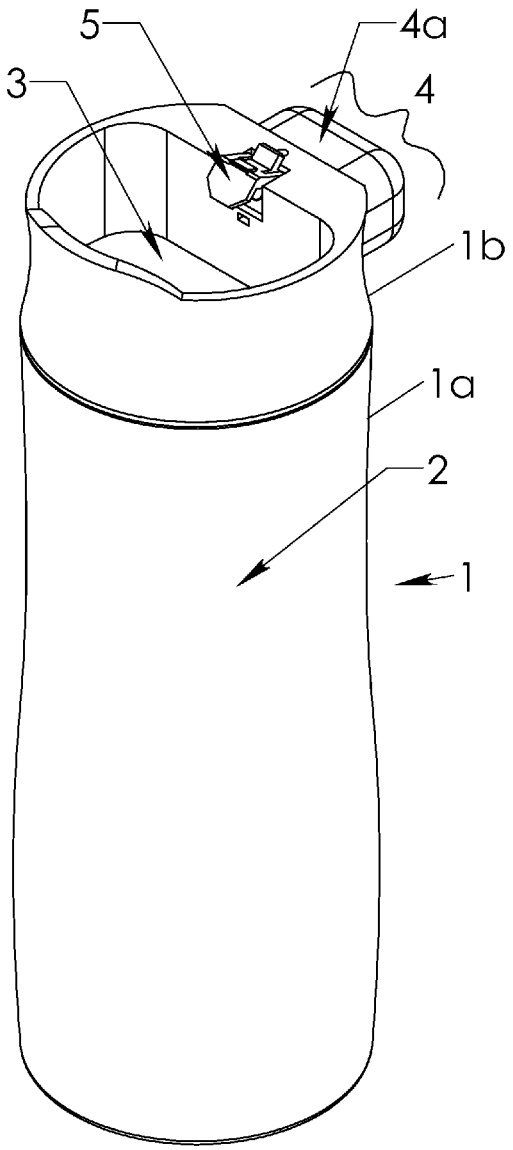
FIG. 1B is a diagram illustrating another perspective view of the vessel, as shown in FIG. 1A, in accordance with the present disclosure.

Referring to FIG. 1B, this diagram illustrates another perspective view of a vessel 1, such as a bottle or a container, as shown in FIG. 1A, in accordance with the present disclosure. The vessel 1 comprises a lower portion 1*a*, having a holding reservoir 2, and an upper portion 1*b*, having a drinking reservoir 3, a closable spout 5, and a pump mechanism 4. The holding reservoir 2 is used to store the bulk of the liquid. When a user (not shown) desires, the user will use the accompanied pump mechanism 4 to move the liquid into the drinking reservoir 3 which accommodates a volume of liquid that is less than the maximum volume capacity of the holding reservoir 2. Once the liquid (not shown) is disposed in the drinking reservoir 3, the user may consume the liquid when it meets the user's specific preferences.

Figure 2:
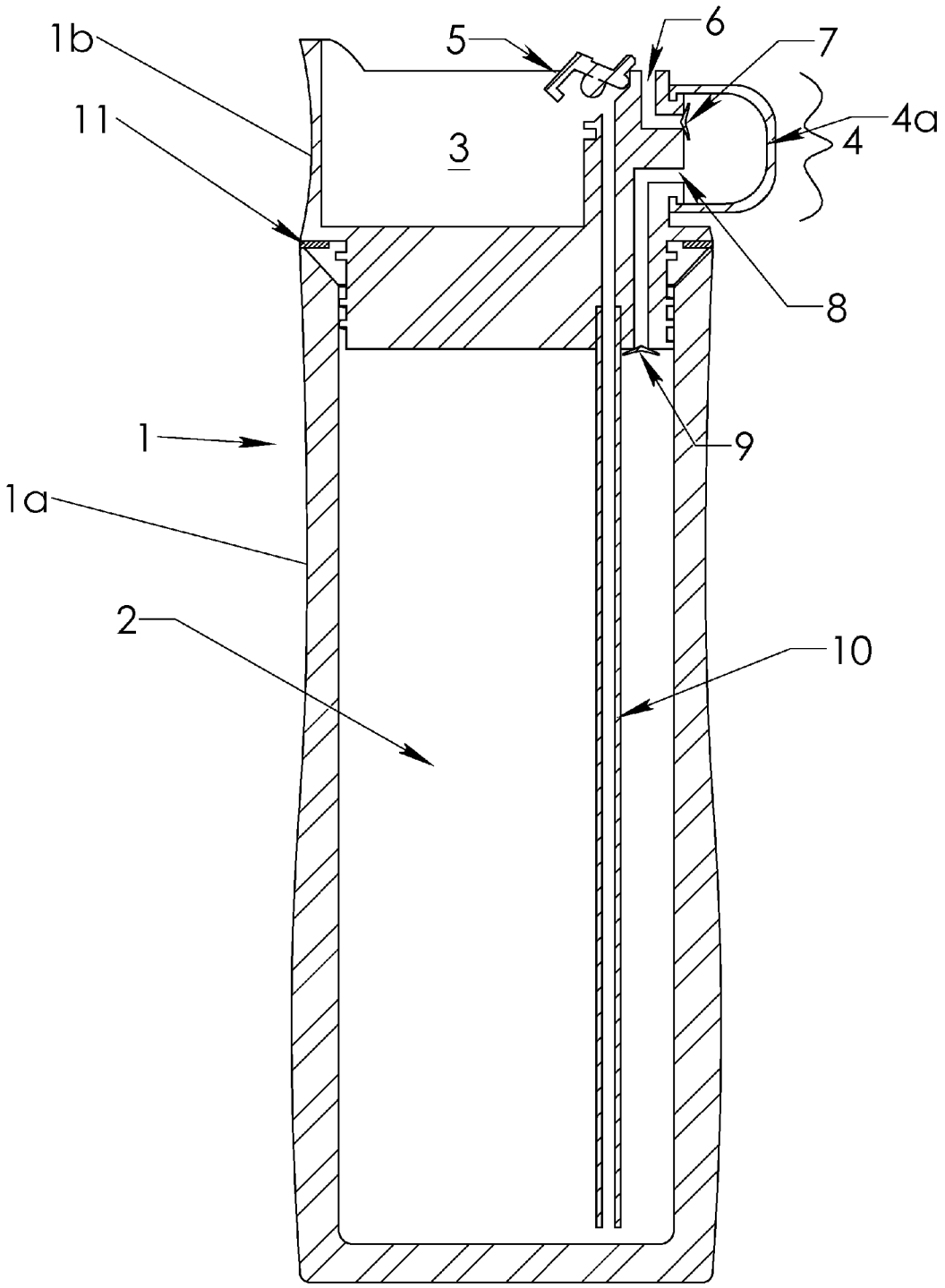
FIG. 2 is a diagram illustrating a cross-sectional view a vessel, in accordance with another embodiment of the present disclosure.

Referring to FIG. 2, this diagram illustrates a cross-sectional view of a vessel 1, in accordance with another embodiment of the present disclosure. The vessel 1 comprises a lower portion 1*a*, having a holding reservoir 2, and an upper portion 1*b*, having a drinking reservoir 3, a closable spout 5, and a pump mechanism 4. The holding reservoir 2 is used to store the bulk of the liquid. When a user (not shown) desires, the user will use the accompanied pump mechanism 4 to move the liquid into the drinking reservoir 3 which accommodates a volume of liquid that is less than the maximum volume capacity of the holding reservoir 2. Once the liquid (not shown) is disposed in the drinking reservoir 3, the user may consume the liquid when it meets the user's specific preferences. The pump mechanism 4 comprises a pump membrane 4*a*, a pump air inlet 6, a pump air inlet valve 7, a pump air outlet 8, and a pump air outlet valve 9. The vessel 1 further comprises a removable liquid dispensing tube 10 for facilitating liquid communication between the holding reservoir 2 and the drinking reservoir 3. The vessel 1 further comprises a seal 11, such as a circular seal, disposed between the lower portion 1*a* and the upper portion 1*b*.

Still referring to FIG. 2, in further detail, the holding reservoir 2 is of a size to hold an amount of liquid adequate for an individual consuming their beverage of choice and may be of any shape that meets a user's demands, such as: as bag, a box, or other shaped container. The size of the holding reservoir 2 is not limited, but is capable of accommodating a volume of liquid in a range of approximately 8 oz to approximately 32 oz. Likewise, the drinking reservoir 3 must be of an adequate size to meet the user's needs. The drinking reservoir 3 is not limited to, but is capable of safely accommodating a volume of liquid in a range of approximately 1 oz to approximately 4 oz without risk of spilling. The drinking reservoir and cap 3 may have a structure for the user to consume the liquid easily, such as: a lip, spout, straw, or any other device that serves a similar function. The pump membrane 4*a* is of adequate size to cause the desired amount of liquid to move from the holding reservoir 2 to the drinking reservoir 3 in approximately 1 pump to approximately 6 pumps. The pump membrane 4*a* comprises at least one of a rubber, a flexible polymer, or any other material, such as an elastic material, that would provide the proper functionality.

Still referring to FIG. 2, the seal 11 prevents leakage between the lower portion 1*a* and the upper portion 1*b*. The lower portion 1*a* and the upper portion 1*b* may coupled together by any technique, such as coupling by way of threaded surfaces, by way of an interference fit, and the like. The overall size of vessel 1 may be of a similar size to other containers holding a similar amount of liquid. When desired, the user depresses the pump membrane 4*a*, which causes a positive pressure that is forced down the pump outlet 8 and through the pump outlet valve 9, thereby increasing pressure in the holding reservoir 2 displacing and forcing liquid up the removable liquid dispensing tube 10 and out the closable spout 5. The closable spout 5 comprises a latch mechanism.

The liquid is then collected in the drinking reservoir 3. Once the user removes pressure from the pump membrane 4*a*, the pump membrane 4*a* reverts to its original form, whereby a negative pressure is effected in the pump membrane 4*a*, thereby activating the pump air inlet valve 7, thereby allowing air to pass through the pump air inlet 6. The inflow of air from the pump air inlet 6 fills the pump membrane 4 and equalizes the pressure gradient. Once one cycle is complete, the user may repeat the action until the desired amount of liquid has filled the drinking reservoir 3.

Figure 3A:
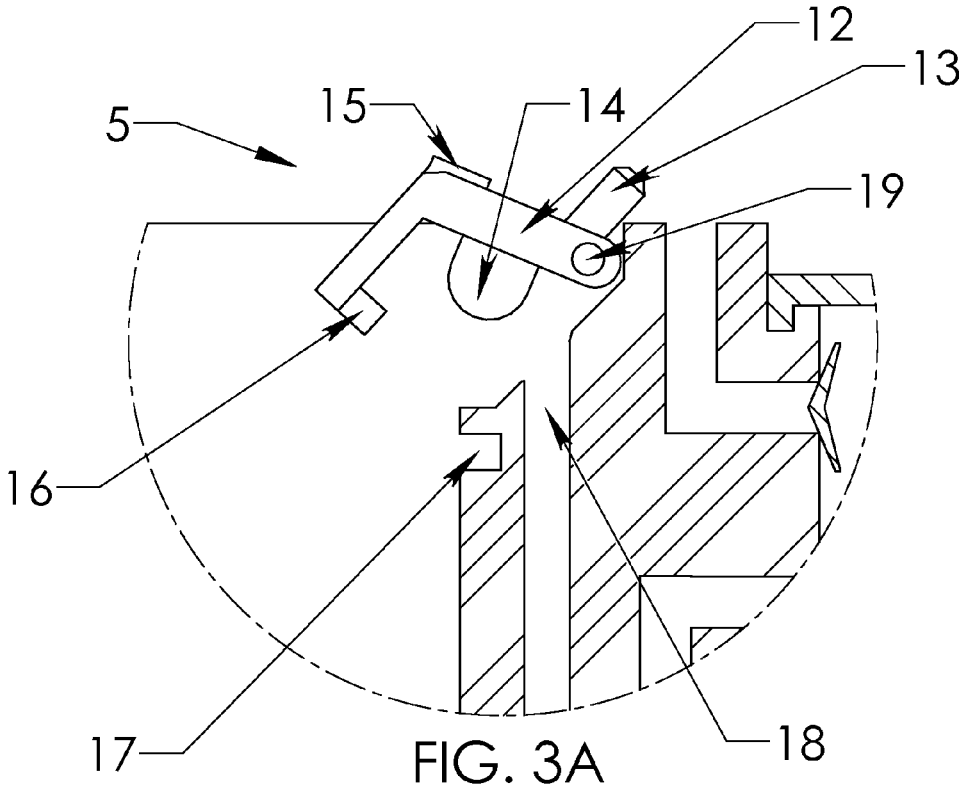
FIG. 3A is a diagram illustrating a cutaway cross-sectional view of a sealing mechanism on a liquid exit to a reservoir on the lid of a vessel in an open configuration, in accordance with an embodiment of the present disclosure.

Referring to FIG. 3A, this diagram illustrates a cutaway cross-sectional view of a sealing mechanism, such as closable spout 5 on a liquid exit 18 to a drinking reservoir 3 of the upper portion 1*b*, such as a lid, of a vessel 1 in an open configuration, in accordance with an embodiment of the present disclosure. The closable spout 5 comprises a closable flap 12, an opening lever 13, a sealing valve 14, a closable push point 15, a closable flap latch 16, a lid latch point 17, and a closable flap pivot point 19. The closable spout 5 seals the liquid exit 18 of the upper portion 1*b* and also serves to deflect incoming liquid from the liquid exit 18, thereby preventing splashing liquid on the user.

Still referring to FIG. 3A, when the user desires to close the container 1, the user will push down on the closable push point 15, thereby disposing the sealing valve 14 in relation to the liquid exit 18, and thereby disposing the closable flap latch 16 in relation to the lid latch point 17. The closable flap latch 16 will hold the closable flap 12 in place and insure a seal between the sealing valve 14 and the liquid exit 18. In operating the vessel 1, the user will push on the opening lever 13, thereby releasing the closable flap latch 16 from the lid latch point 17, thereby releasing the sealing valve 14 from the liquid exit 18, and thereby allowing liquid to therethrough flow. In this configuration, the closable flap 12 also provides an adequate amount of protection so that the liquid from the liquid exit point 18 will be channeled into the drinking reservoir 3 without splashing the user. During the opening and closing cycles of the closable spout 5, the closable flap 12 will pivot about the closable flap pivot point 19. The closable spout 5 comprises a material having a rigidity, strength, and flexibility that is conducive to long-term cycling of the opening and closing action, such as at least one of a plastic, a composite, or a metal. The sealing valve 14 comprises a flexible material conducive to sealing the liquid exit 18, such as a rubber or any other flexible polymer.

Figure 3B:
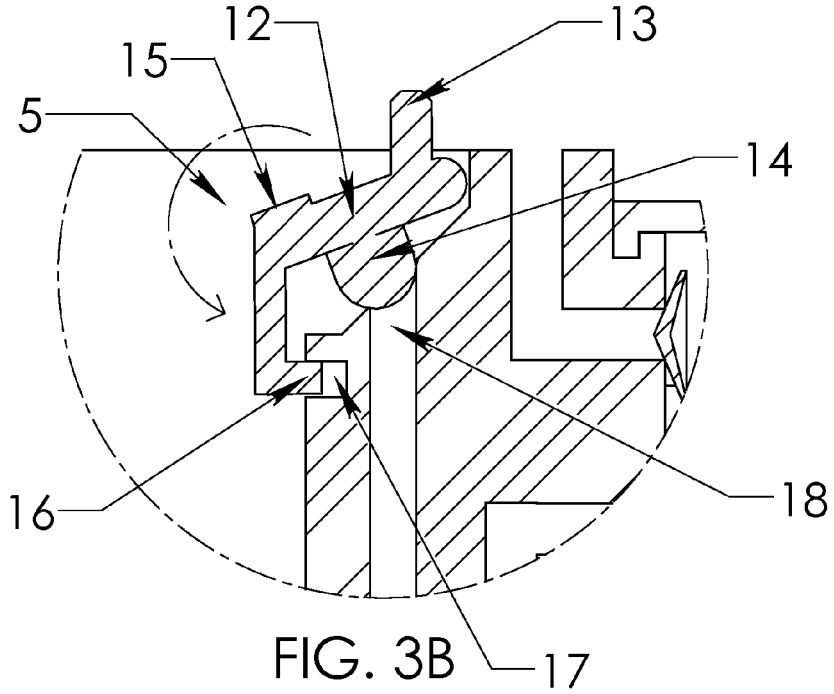
FIG. 3B is a diagram illustrating a cutaway cross-sectional view of a sealing mechanism on a liquid exit to a reservoir on the lid of a vessel in a closed configuration, as shown in FIG. 3A, in accordance with an embodiment of the present disclosure.

Referring to FIG. 3B, this diagram illustrates a cutaway cross-sectional view of a sealing mechanism, such as closable spout 5 on a liquid exit 18 to a drinking reservoir 3 of the upper portion 1*b*, such as a lid, of a vessel 1, as shown in FIG. 3A, in a closed configuration, in accordance with an embodiment of the present disclosure. The closable spout 5 comprises a closable flap 12, an opening lever 13, a sealing valve 14, a closable push point 15, a closable flap latch 16, a lid latch point 17, a liquid exit 18, and a closable flap pivot point 19. The closable spout 5 seals the liquid exit 18 and also serves to deflect incoming liquid from the liquid exit 18, thereby preventing splashing liquid on the user.

Example 2

Embodiment with an Automatically Closable Spout

Figure 4A:
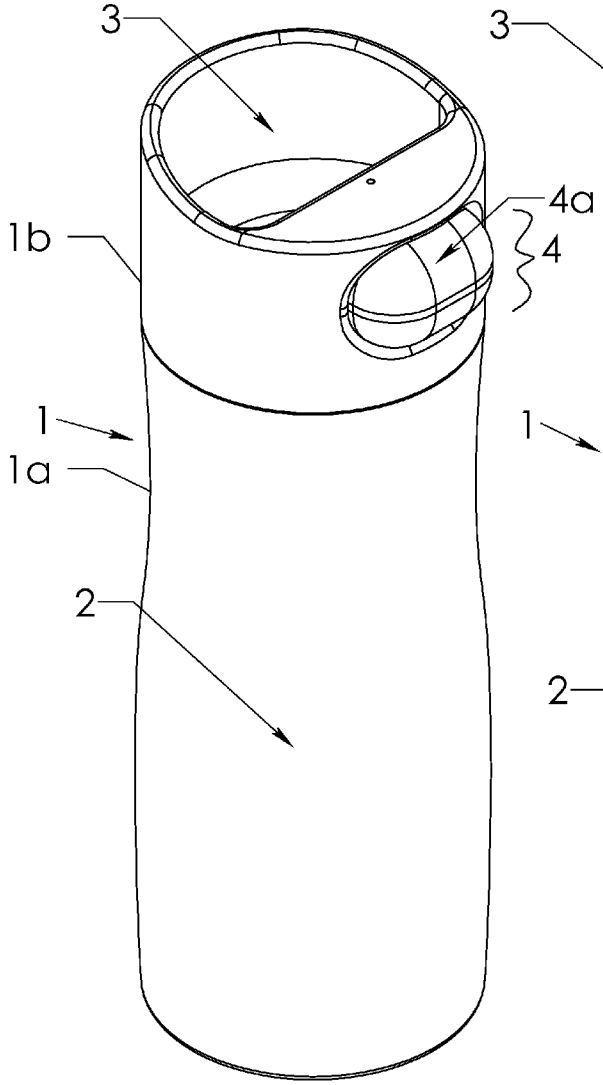
FIG. 4A is a diagram illustrating a perspective view of a vessel with a pump membrane and an automatically closable spout, in accordance with an embodiment of the present disclosure.

Referring to FIG. 4A, this diagram illustrates a perspective view of a vessel 1 with a pump membrane 4*a* and an automatically closable spout 21, in accordance with an embodiment of the present disclosure. The vessel 1 comprises a lower portion 1*a*, having a holding reservoir 2, and an upper portion 1*b*, having a drinking reservoir 3, an automatically closable spout 21, and a pump mechanism 4.

Figure 4B:
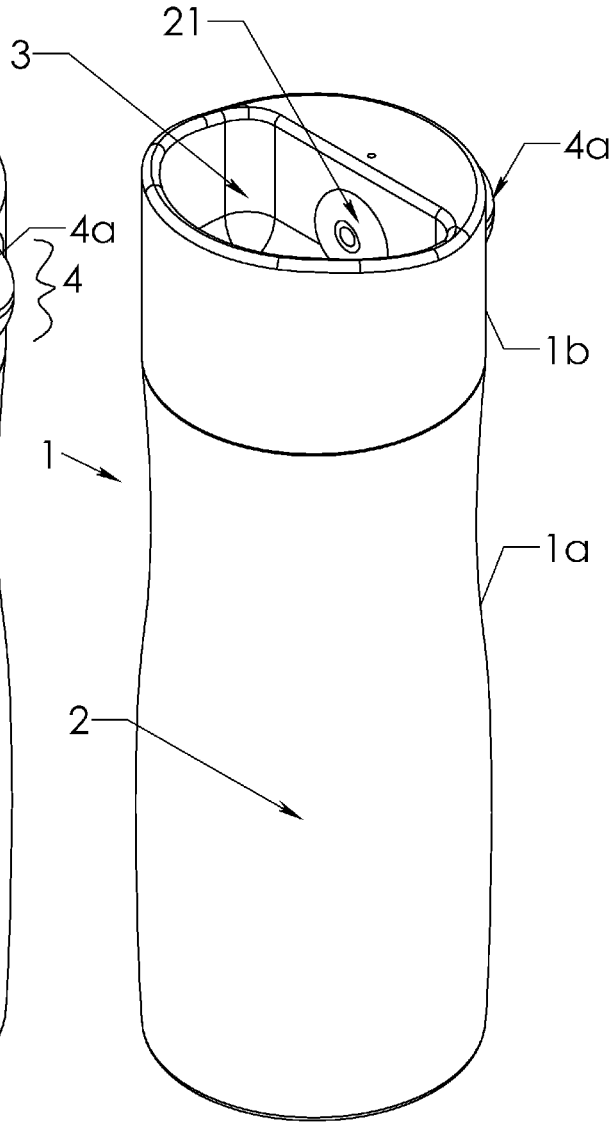
FIG. 4B is a diagram illustrating another perspective view of a vessel with a pump membrane and an automatically closable spout, as shown in FIG. 4A, in accordance with an embodiment of the present disclosure.

FIG. 4B is a diagram illustrating another perspective view of a vessel 1 with a pump membrane 4*a* and an automatically closable spout 21, as shown in FIG. 4A, in accordance with an embodiment of the present disclosure. The vessel 1 comprises a lower portion 1*a*, having a holding reservoir 2, and an upper portion 1*b*, having a drinking reservoir 3, an automatically closable spout 21, and a pump mechanism 4.

Figure 5:
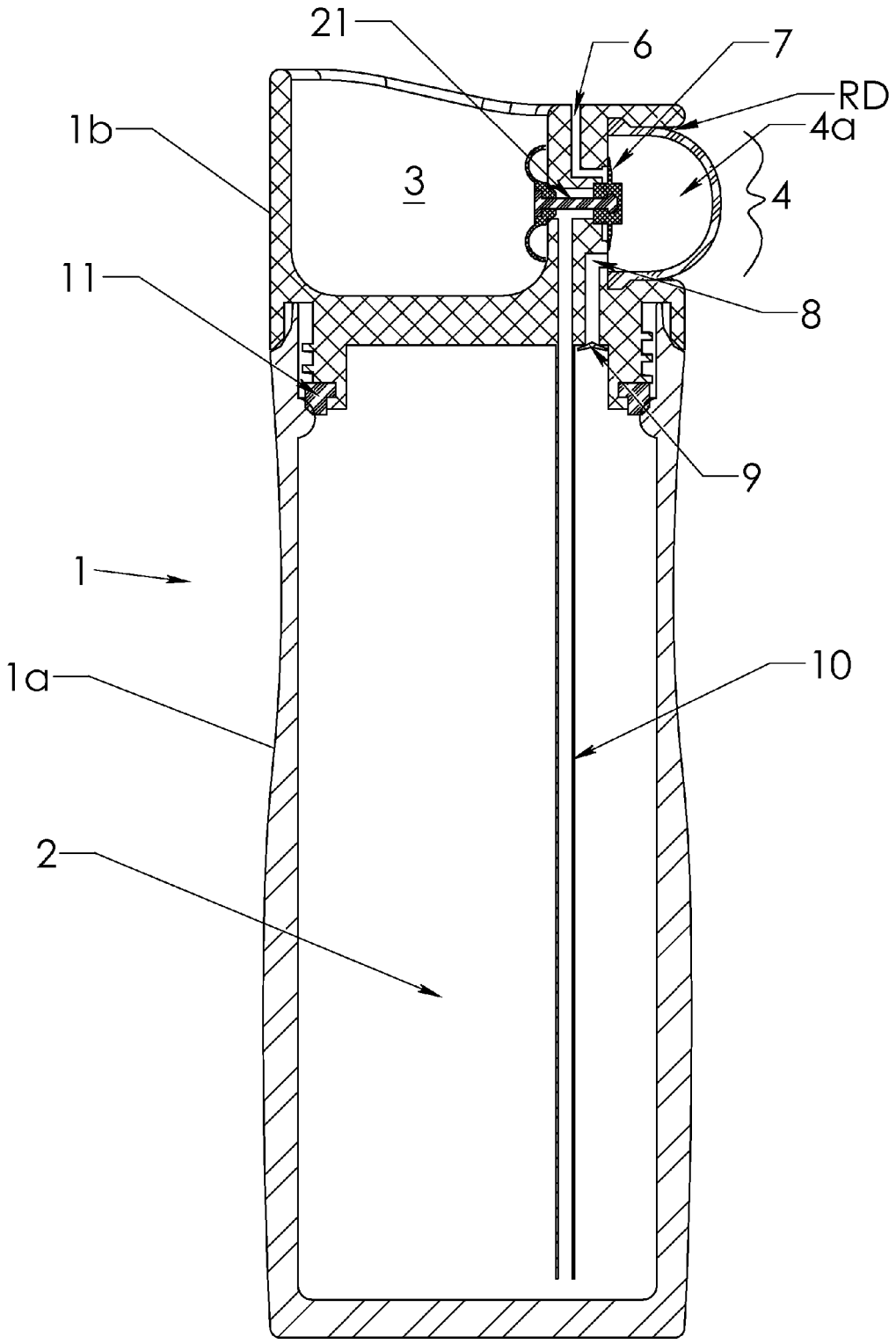
FIG. 5 is a diagram illustrating a cross-sectional view of a vessel with a pump membrane and an automatically closable spout, in accordance with an embodiment of the present disclosure.

Referring to FIG. 5, this diagram illustrates a cross-sectional view of a vessel 1 with a pump mechanism 4 and an automatically closable spout 21, as shown in FIG. 4A, in accordance with an embodiment of the present disclosure. The vessel 1 comprises a lower portion 1*a*, having a holding reservoir 2, and an upper portion 1*b*, having a drinking reservoir 3, an automatically closable spout 21, and a pump mechanism 4. The pump mechanism 4 comprises a pump membrane 4*a*, a pump air inlet 6, a pump air outlet 8, a pump air outlet valve 9, and a seal 11. The vessel 1 further comprises a removable liquid tube 10, such as a straw, for facilitating liquid communication between the holding reservoir 2 and the drinking reservoir 3. The vessel 1 further comprises a seal 11, such as a circular seal, disposed between the lower portion 1*a* and the upper portion 1*b*.

Still referring to FIG. 5, the pump mechanism 4, comprising a membrane pump 4*a*, fits into a receiving depression RD. As the user depresses the pump membrane 4*a*, a positive pressure is created inside, which pushes the pump membrane 4 against the edges of the receiving depression RD in the drinking reservoir 3, which further sealing the pump membrane 4*a*. When desired, the user will depress the pump membrane 4, which causes a positive pressure through the pump outlet 8 and through the pump outlet valve 9, thereby increasing pressure in the holding reservoir 2. Once the user removes pressure from the pump membrane 4*a*, the pump membrane 4*a* returns to its original form. This causes a negative pressure in the pump membrane 4*a*, which activates the inlet valve 7 associated with the automatically closable spout 21, thereby allowing gas, such as air, to pass through the pump air inlet 6. The inflow of air (not shown) from the pump air inlet 6 fills the pump membrane 4*a*, thereby equalizing the pressure gradient. Because the automatically closable spout 21 rests in the closed position, the increased pressure in the holding reservoir 2 remains until the user opens the automatically closable spout 21, thereby allowing the internal pressure to force liquid to travel up the liquid dispensing tube 10 and into the drinking reservoir and cap 3. Opening the automatically closable spout 21 will be discussed further in the following paragraphs. The user may repeat this process until the desired amount of liquid has filled the drinking reservoir 3.

Figure 6A:
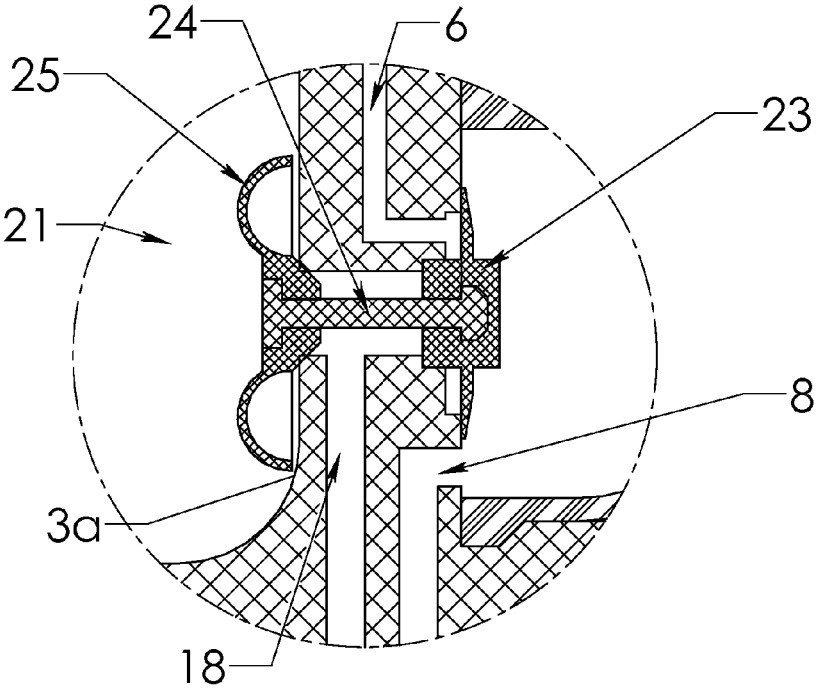
FIG. 6A is a diagram illustrating a cutaway cross-sectional view of an automatically closable spout to a reservoir on the lid of a vessel in the closed configuration, in accordance with an embodiment of the present disclosure.

Referring to FIG. 6A, this diagram illustrates a cutaway cross-sectional view of an automatically closable spout 21 to a drinking reservoir 3 of the upper portion 1*b* of a vessel 1 in an open configuration, in accordance with an embodiment of the present disclosure. The pump mechanism 4 comprises the pump membrane 4*a*. The automatically closable spout 21, shown here in the closed position, comprises a depressor valve 23, the spout rod 24, and the spout deflector seal 25. The upper portion 1*b* comprises a gas inlet 6, the gas outlet 8, and the liquid exit 18. In further detail, the spout rod 24 comprises a length such that a tension is effected between the depressor valve 23 and the spout deflector seal 25 by slightly deforming the spout deflector seal 25. This also ensures an airtight seal from both ends of the automatically closable spout 21. When the user desires liquid in the drinking reservoir 3, the user will push the pump membrane 4*a* which actuates the depressor valve 23, thereby deploying the automatically closable spout 21 into the open position.

Figure 6B:
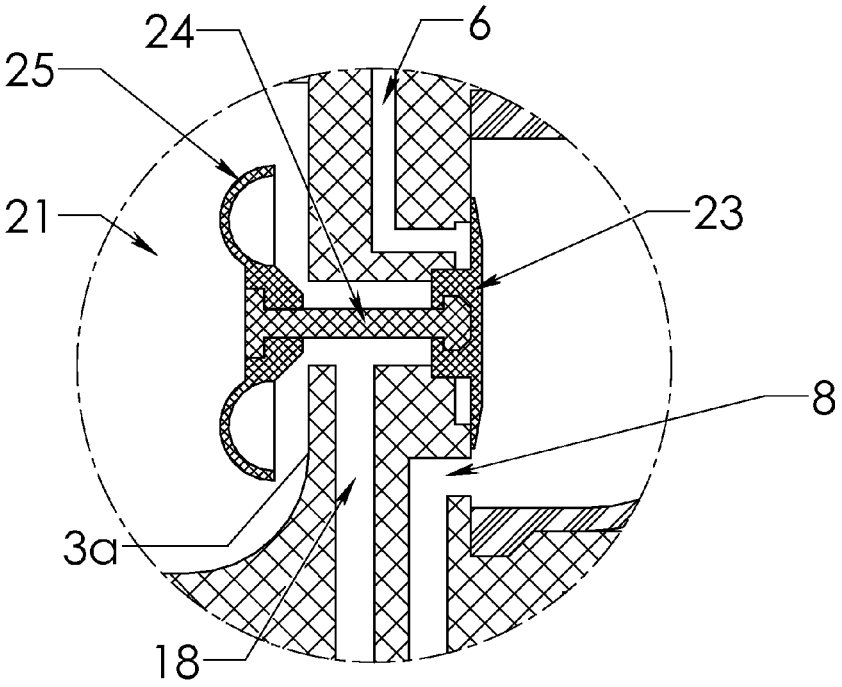
FIG. 6B is a diagram illustrating a cutaway cross-sectional view of an automatically closable spout to a reservoir on the lid of a vessel, as shown in FIG. 6A, now in the open configuration, in accordance with an embodiment of the present disclosure.

Referring to FIG. 6B, this diagram illustrates a cutaway cross-sectional view of an automatically closable spout 21 to a drinking reservoir 3 of the upper portion 1*b* of a vessel 1, as shown in FIG. 6A, now in the open configuration, in accordance with an embodiment of the present disclosure. The pump mechanism 4 comprises the pump membrane 4*a*. The automatically closable spout 21, shown here in the open position, comprises a depressor valve 23, the spout rod 24, and the spout deflector seal 25. The upper portion 1*b* comprises a gas inlet 6, the gas outlet 8, and the liquid exit 18. In further detail, a positive pressure is effected in the holding reservoir 2 by pressing the pump membrane 4*a*, thereby actuating the depressor valve 23, thereby moving the spout rod 24 away from the pump membrane 4*a*, thereby moving the spout deflector seal 25 away from a wall 3*a* of the drinking reservoir 3, and thereby allowing liquid to travel up the liquid dispensing tube 10 and through the liquid exit 18. The spout deflector seal 25 comprises a shape, e.g., a semi-toroid shape, a convex flange, and the like, such that the liquid spray is captured and redirected (deflected) into the drinking reservoir 3. The membrane depressor valve 23 and the spout deflector seal 25 each comprise a material having adequate necessary flexibility, elasticity, and sealing characteristics, such as a rubber, a flexible polymer, or a flexible composite material. The spout rod 24 comprises a rigid material, such as a plastic, a rigid composite material, a metal, a metal alloy.

Figure 7:
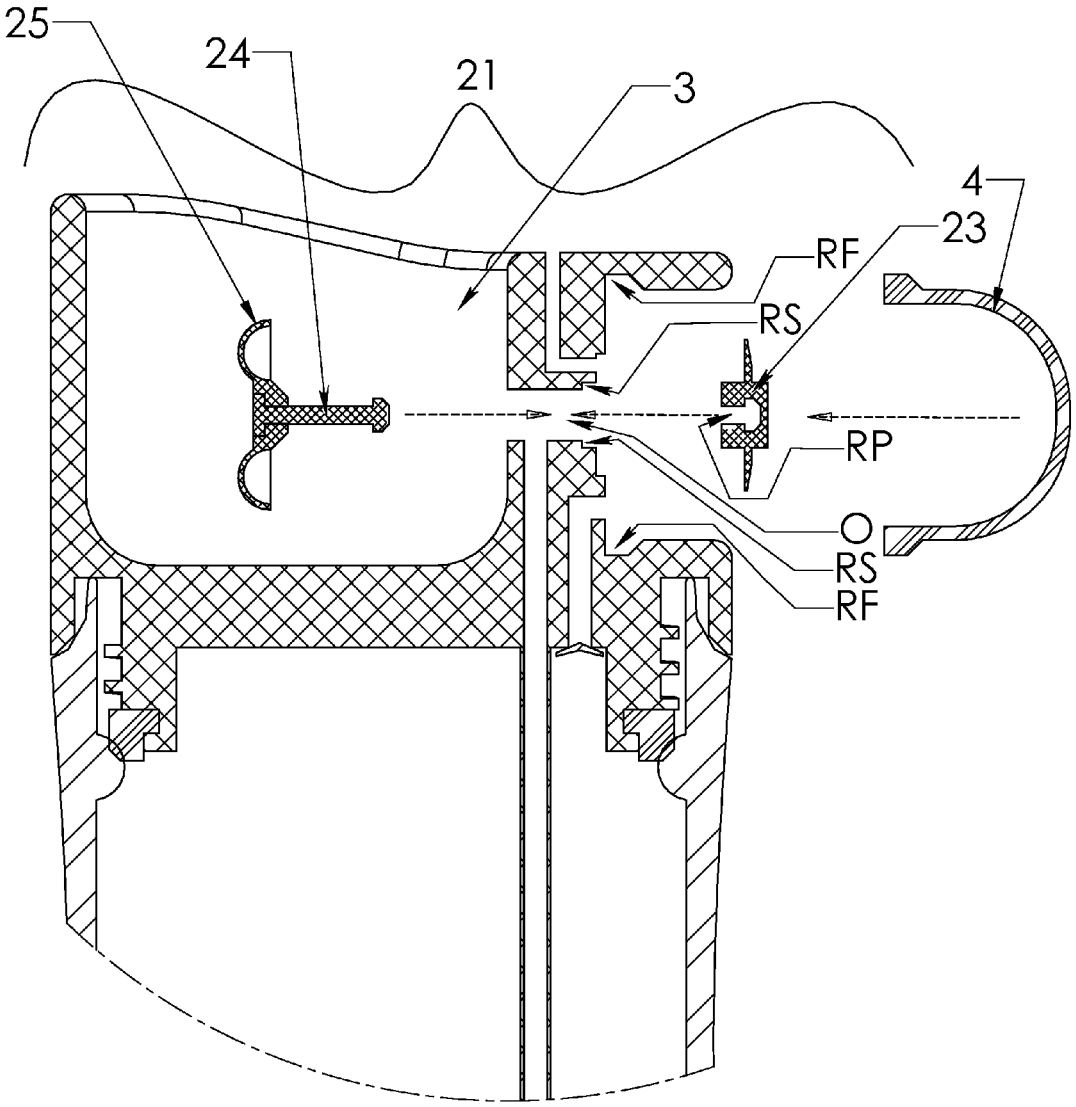
FIG. 7 is a diagram illustrating an exploded cutaway cross-sectional view of an assembly of an automatically closable spout and a pump membrane to a reservoir on a the lid of a vessel, in accordance with an embodiment of the present disclosure.

Referring to FIG. 7, this diagram illustrates an exploded cutaway cross-sectional view of an automatically closable spout 21 and a pump membrane 4*a* coupled with an upper portion 1*b* of a vessel 1, in accordance with an embodiment of the present disclosure. The pump mechanism 4 comprises the pump membrane 4*a* and the automatically closable spout 21. The upper portion 1*b* comprises the pump air inlet 6, the pump air outlet 8, and the liquid exit 18. The automatically closable spout 21 comprises a depressor valve 23, a spout rod 24, and a spout deflector seal 25. The automatically closable spout 21 is shown in a disassembled state. In further detail, the automatically closable spout 21 can be fabricated by disposing the spout rod 24 and the spout seal deflector 25 in relation to an orifice O of the upper portion 1*b*, disposing the depressor valve 23 in a receiving slot RS of the upper portion 1*b*, disposing a distal end of the spout rod 24 into a receiving portion RP of the depressor valve 23, whereby the distal end of the spout rod 24 is retained by a technique, such as an interference fit, and the pump membrane 4*a* is disposed in a receiving feature RF of the upper portion 1*b*, whereby the pump membrane 4*a* is also retained by a technique, such as an interference fit. The foregoing configuration for the pump mechanism 4 facilitates disassembly and reassembly of the components, thereby facilitating cleaning of the passageways, e.g., the gas and liquid passageways of the upper portion 1*b* of the vessel 1.

Some further benefits of the vessel 1 include, but are not limited to, minimizing a risk of spilling the bulk of a liquid disposed in the holding reservoir 2 while providing features that facilitate consumption of the liquid, and facilitating cooling only a small amount of the liquid at a time in the drinking reservoir 3 while maintaining the temperature of the bulk of a heated liquid, such as coffee or tea, for a longer period of time in the holding reservoir 2, providing extended thermal maintenance of the liquid in the holding reservoir 2 by way of an insulated embodiment of the vessel 1, providing easy drinkability by way of a simple mug configuration, travel mug configuration, desk mug configuration, or other appropriate drinking vessel configuration, facilitating fabrication by using a low number of parts, and facilitating cleaning by providing easy cleanability of the liquid and gas passageways by way of ready disassembly and reassembly of the low number of parts having easy coupling feature, such as an interference fit, for quick connect and quick disconnect.

In a general embodiment, the vessel 1 comprises a holding reservoir 2 that has a large volume for containing the bulk of a liquid, a drinking reservoir 3 that has a smaller volume for short term storage and consumption, and a transportation mechanism that moves the liquid from the holding reservoir 2 to the drinking reservoir 3. The transportation mechanism is contemplated by the present disclosure to include a pump mechanism 4, having a pump membrane 4*a*, that facilitates proper cleaning, thereby providing a sanitary vessel 1, and thereby minimizing the risk of food poisoning or the transmission of other infections to the user. The pump mechanism 4 contains fewer moving parts, has a smaller size, is less likely to inadvertently engage other objects, and is less likely to break than related art drinking vessel components.

Also contemplated by the present disclosure is the disposition of the pump membrane 4*a* in relation to the upper portion 1*b* for providing an ergonomic feature for the user, e.g., the vessel 1 facilitates single-handed operation of the pump mechanism 4 and facilitates redisposing the upper portion 1*b* in relation to the lower portion 1*a* after refilling the holding reservoir 2 with a liquid, e.g., a beverage, when transposing the upper portion 1*b* in relation to a lower portion 1*a* (with full pumping functionality) of any other vessel 1, or when retrofitting the upper portion 1*b* to any other interfaceable preexisting drinking vessel by way of a technique, such as a complimentary threading and an interference fit.

Furthermore, in an embodiment of the vessel 1, comprising the automatically closable spout 21, hot liquids are prevented from spraying or splashing the user during operation by automatically sealing (undeployed state) and deflecting the liquid into the drinking reservoir 3 during filling (deployed state). Easy removal of the components of the pump mechanism 4 facilitates cleaning of the gas and liquid passage ways and help to reduce the risk of trapped hazardous materials, such as contaminants and pollutants, as well as trapped biohazardous materials, such as germs, e.g., bacteria, viruses, and the like.

Information as herein shown and described in detail is fully capable of attaining the above-described object of the present disclosure, the presently preferred embodiment of the present disclosure, and is, thus, representative of the subject matter which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, workpiece, and fabrication material detail may be made, without departing from the spirit and scope of the present disclosure, as set forth in the appended claims, as may be apparent to those of ordinary skill in the art, are also encompassed by the present disclosure.

What is claimed:

1. A pump mechanism comprising:

a pump membrane;

a one-way pump outlet valve operable to pass a first fluid from the pump membrane to a pump air outlet;

a closable flap including:

a seal portion operable to seal a liquid exit, and a liquid deflector including a cupped portion extending outside the seal portion to redirect a direction of exit of liquid from the liquid exit;

a spout rod including a first end coupled to the closable flap;

a depressor valve coupled to a second end of the spout rod, the depressor valve positioned inside the pump membrane, wherein actuating the depressor valve displaces the spout rod, opening the closable flap.

2. The pump mechanism of claim 1, wherein compressing the pump membrane to a substantially compressed position actuates the depressor valve.

3. The pump mechanism of claim 1, wherein the closable flap is biased to close upon deactuation of the depressor valve.

4. The pump mechanism of claim 1, further comprising:

a one-way pump inlet valve operable to pass the first fluid into the pump membrane.

5. The pump mechanism of claim 1, further comprising:

a one-way pump inlet valve operable to pass the first fluid into the pump membrane, wherein the one-way pump inlet valve is formed from a peripheral portion of the depressor valve.

6. The pump mechanism of claim 1, wherein the liquid exit includes a liquid tube.

7. An apparatus comprising:

a fluid container including an opening;

an upper portion that sealingly couples to the opening of the fluid container, the upper portion including a liquid exit; and a pump mechanism coupled to the upper portion, the pump mechanism including:

a pump membrane;

a one-way pump outlet valve operable to pass a first fluid from the pump membrane to a pump air outlet;

a closable flap including:

a seal portion operable to seal the liquid exit, and a liquid deflector including a cupped portion extending outside the seal portion to redirect a direction of exit of liquid from the liquid exit;

a spout rod including a first end coupled to the closable flap; and a depressor valve coupled to a second end of the spout rod, the depressor valve positioned inside the pump membrane, wherein actuating the depressor valve displaces the spout rod, opening the closable flap.

8. The apparatus of claim 7, wherein the closable flap is biased to close upon deactuation of a depressor valve.

9. The apparatus of claim 7, further comprising:

a one-way pump inlet valve operable to pass the first fluid into the pump membrane, wherein the one-way pump inlet valve is formed from a peripheral portion of the depressor valve.

10. The apparatus of claim 7, wherein the upper portion includes a receiving depression operable to seat the pump membrane.

11. The apparatus of claim 7, wherein the fluid container includes vacuum sealed walls.

12. The apparatus of claim 7, wherein the upper portion further includes a drinking reservoir operable to collect the liquid redirected on exit from the fluid container.

13. A method for assembling a pump mechanism, including:

positioning a closable flap at a liquid exit, the closable flap including a seal portion operable to seal the liquid exit, and a liquid deflector including a cupped portion extending outside the seal portion to redirect a direction of exit of liquid from the liquid exit;

positioning a depressor valve in a receiving depression;

coupling a first end of a spout rod to the closable flap and coupling a second end of the spout rod to the depressor valve;

seating a pump membrane in the receiving depression; and positioning a one-way pump outlet valve on a pump air outlet, the one-way pump outlet valve operable to pass a first fluid from the pump membrane into the fluid container.

14. The method for assembling a pump mechanism of claim 13, further including:

coupling a liquid tube to the liquid exit.

* * * * *